United States Patent [19]

Romanow et al.

[11] Patent Number: 4,556,168

[45] Date of Patent: Dec. 3, 1985

[54] RAPID RESPONSE WATER HEATING AND DELIVERY SYSTEM

[75] Inventors: Peter Romanow, Novi; Richard Andreasen, Northville, both of Mich.

[73] Assignee: Star Manufacturing Company, Brighton, Mich.

[21] Appl. No.: 577,033

[22] Filed: Feb. 6, 1984

[51] Int. Cl.[4] ..... F22B 35/00; G05D 23/00

[52] U.S. Cl. ..... 236/25 A; 219/309; 137/487

[58] Field of Search ..... 237/19; 236/25 A, 25 R, 236/20 R; 126/362; 219/307, 309; 137/486, 487

[56] References Cited

FOREIGN PATENT DOCUMENTS 99247 8/1979 Japan ..... 236/25 A 157953 9/1982 Japan ..... 236/25 A 1601940 11/1981 United Kingdom ..... 236/25 A

*Primary Examiner*—Henry Bennett

*Attorney, Agent, or Firm*—Harness, Dickey & Pierce

[57] ABSTRACT

A rapid response water heating and delivery system having a flow restrictor which creates a pressure differential within the water inlet point to the heating system which is sensed by a pressure differential switch for activating the heating elements of the system. At a predetermined flow rate, the flow restrictor yields a threshold pressure differential which causes the pressure differential switch to activate the heating elements of the system. The pressure differential switch can be adjusted to actuate the heating elements at different desired levels of water flow through the system.

21 Claims, 10 Drawing Figures

RAPID RESPONSE WATER HEATING AND DELIVERY SYSTEM

BACKGROUND AND SUMMARY OF THE INVENTION

The present invention relates to water heating and delivery systems employing high wattage heating elements to effect rapid response water heating, and more particularly to an improved means for controlling activation and deactivation of the heating elements in such a rapid response system.

Rapid response water heating and delivery systems are typically utilized either as a replacement for existing hot water heaters having large tank capacities, or are connected in series with such existing hot water tanks at a point near a water delivery location such as a faucet to improve the overall energy efficiency of the system by enabling the large capacity tank to be set at a lower temperature, with the rapid response system acting as an auxiliary heater to deliver hot water at a desired use temperature at the delivery location only as needed. Typical applications of such rapid response systems include health care facilities, laboratories, photo processing labs, industrial wash stations, hotels and restaurants, residential uses, and as a backup for solar water heating systems.

Such rapid response water heating systems generally include high wattage heating elements operative to deliver large amounts of energy to water very quickly as it flows through the system to raise the water from an input temperature level to a desired output temperature. The operation of such rapid response systems requires that the activation and deactivation of the high wattage heating elements be closely controlled to avoid conditions wherein the elements are operating during times of reduced water flow through the system. More particularly, it is important to insure an adequate flow of water through such rapid response systems during operation of such heating elements to avoid burning out the heating elements and/or otherwise damaging the system. For this reason, such rapid response heating systems require means to sense water flow rates, as well as means to activate the heating elements only when desired flow rates exist to avoid overheating. Known means for effecting such control utilize flow sensing devices equipped with magnetic proximity switches for activating and deactivating the electrical system for delivering energy to the heating elements. However, it has been found that rapid response systems utilizing such flow sensing devices are disadvantageous and indeed have a limited life when utilized with water sources or environments having a high iron content. It is, therefore, desirable to provide a rapid response water heating and delivery system which possesses a life span which is unaffected by the type of water being heated or the iron content therein.

The present invention is intended to satisfy the above desirable features and objectives through the provision of a new and improved rapid response water heating and delivery system having a flow sensing and heater activating means which is unaffected by the type of water flowing through the system. The invention includes a flow restrictor which creates a pressure differential within the water inlet point to the heating system. At a predetermined input flow rate, the flow restrictor yields a threshold pressure differential that is sensed by a novel pressure differential switch, which in turn activates the electrical system for energizing the heating elements. Upon reduction of water flow through the system below the predetermined flow rate, the pressure switch will likewise operate to deactivate the electrical system. The pressure differential switch also can be adjusted to actuate the electrical system at different desired levels of flow in the system.

The above and other features of the invention will become apparent from a reading of the detailed description of the preferred embodiment, which makes reference to the following set of drawings.

DETAILED DESCRIPTION OF THE PREFERRED EMBODIMENT

Figure 1:
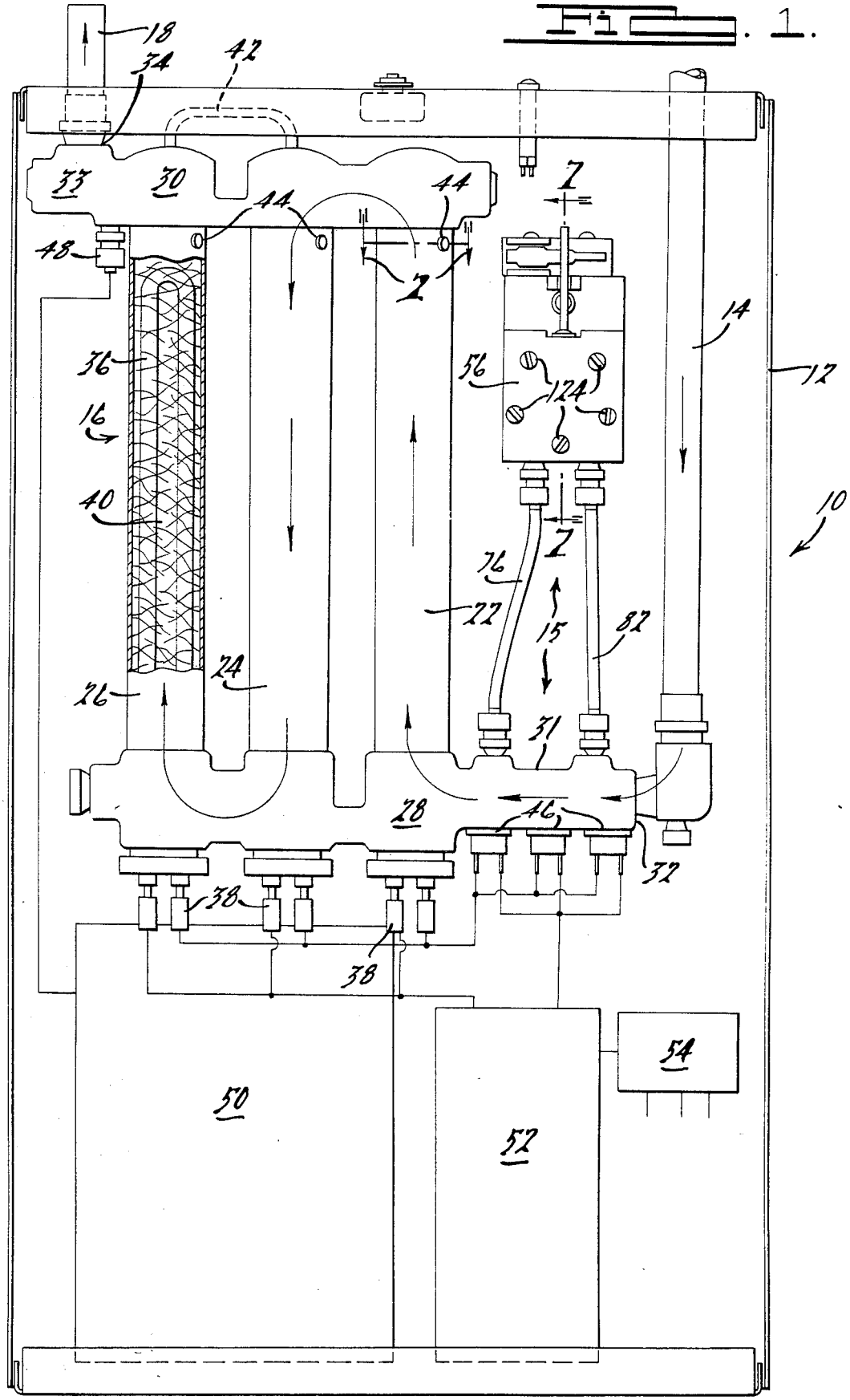
FIG. 1 is a front view, partially in section, of a water heating and delivery system in accordance with the present invention.

Referring now more specifically to the drawings, a rapid response water heating and delivery system in accordance with the present invention is shown generally in FIG. 1 at 10. The system 10 includes a housing 12 within which is contained a cold water inlet line 14 which communicates with and delivers inlet water at an input temperature level through a heater actuating system 15 to a heat exchanger assembly 16. The assembly 16 thereafter heats the inlet water to a desired output temperature and delivers same to a hot water outlet line 18. As shown in FIG. 1, the heat exchanger assembly 16 includes three spaced hollow copper heating columns 22, 24 and 26, respectively, the ends of which are received and fixed within cast brass alloy end fittings 28 and 30, respectively. Each of the end fittings 28 and 30 define passageways (not shown) which communicate between and interconnect the ends of hollow columns 22, 24 and 26 to enable water to flow through the assembly 16 along the flow path shown by the arrows in FIG. 1. End fitting 28 also includes a depending portion 31 which defines a water inlet 32 through which the cold water inlet line 14 is operatively connected with the system 10. End fitting 30 similarly includes a depending portion 33 which defines a hot water outlet 34 operatively connected with the hot water outlet line 18. The heat exchanger assembly 16 also includes water heating elements 36 which are retained within end fitting 28 and extend into each of the heating columns 22, 24 and 26.

The heating elements 36 are energized through terminals 38 extending through end fitting 28 as shown in FIG. 1. A copper mesh material 40 is also contained within each of the heating columns 22, 24 and 26 to facilitate fluid mixing and thus an even heating of the water as it flows through the heat exchanger assembly 16 during operation of the heating elements 36.

Figure 2:
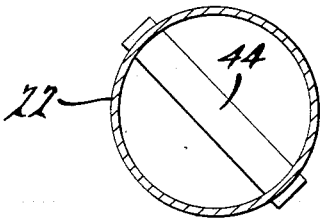
FIG. 2 is a sectional view taken in the direction of Line 2—2 of FIG. 1.

The system 10 also includes a bleed line 42 which communicates between portions of end fitting 30 to operate as a conduit between heating columns 24 and 26 for bleeding off any trapped air which may be contained within the system 10 prior to activation of the heating elements 36. As shown in FIGS. 1 and 2, the system 10 further includes overheat thermal cut-off fuses 44 located at the top of and extending through each of heating columns 22, 24 and 26. These cut-off fuses 44 operate to sense water temperature and are designed to melt when the water temperature in the assembly 16 exceeds a predetermined threshold level to cut off power to the system 10 and prevent undesired overheating of elements 36. Shown in FIG. 1 in schematic form are a series of power triacs 46 for delivering electrical power to the heating elements 36, as well as a temperature sensor 48 extending into portion 33 adjacent the hot water outlet 34 to measure the output temperature of water which has passed through assembly 16. The temperature sensor 48 is operatively connected with an electronic temperature controller 50 such as shown in U.S. Pat. No. 4,337,388 for controlling the energy input to the heating elements 36 to maintain the output temperature of the water at a desired level during normal system operation. Also shown in schematic form in FIG. 1 are fuse and terminal blocks 52 and 54 which form part of the electrical power delivery system.

The heater activating system 15 is shown more fully in FIGS. 3 through 8. In this regard, and as described below, FIGS. 3 through 6 illustate portions of the activating system 15 which create a pressure signal that is transmitted to a pressure differential switch 56 shown generally in FIG. 1 and more specifically in FIGS. 7 and 8. The heater activating system 15 includes depending portion 31 of end fitting 28, which is formed with a through passageway 60 that defines an axially extending threaded cylindrical inlet chamber 62, a reduced diameter outlet chamber 64, and an annular locating shoulder 66 disposed between inlet chamber 62 and outlet chamber 64. Passageway 60 also defines a channel 68 disposed at end 70 of outlet chamber 64 which communicates with a passageway (not shown) in end fitting 28 that opens into heating column 22. Passageway 60 thus effectively forms a conduit through which water flows from the cold water inlet line 14 to and into the heat exchanger assembly 16 for heating. Depending portion 31 also defines a bore 72 extending normally of outlet chamber 64 which receives a threaded fitting 74 for attaching a pressure line 76 operatively connected to the pressure differential switch 56. Depending portion 31 is further formed with a second bore 78 which communicates with and extends normally of inlet chamber 62. The second bore 78 is adapted to receive a threaded fitting 80 attaching a pressure line 82 that is operatively connected with the pressure differential switch 56.

Retained within passageway 60 is a flow restrictor 84 formed to define an axially extending cylindrical shank 86 having a raised threaded portion 88 dimensioned to threadably engage the sidewalls of inlet chamber 62. Shank 86 also defines an end face 90 having a keyway 92 for facilitating the threaded assembly of the flow restrictor 84 within passageway 60 with the end of threaded portion 88 in abutting engagement with locating shoulder 66 in the manner shown in FIG. 3. Extending axially from shank 86 opposite end face 90 is a flow diffuser 94 formed to define a cylindrical collar portion 96 having a series of axially spaced circumferentially extending ribs 98 on its outer wall, and which terminates in a diffuser head shown in FIG. 4 at 100. The diffuser head 100 includes a cylindrical shoulder 101 and terminates in an end face 102 which is open to and faces outlet chamber 64.

Figure 4:
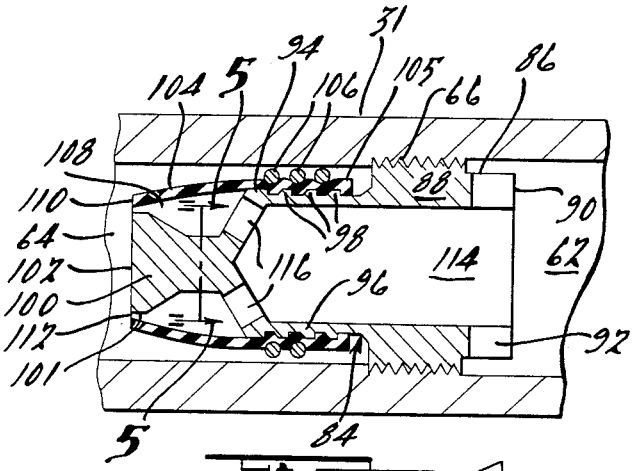
FIG. 4 is a sectional view taken generally in the direction of Line 4—4 of FIG. 3.
Figure 6:
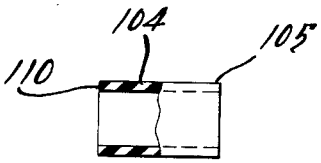
FIG. 6 is a partial sectional view of a portion of the present invention shown in FIG. 4.
Figure 3:
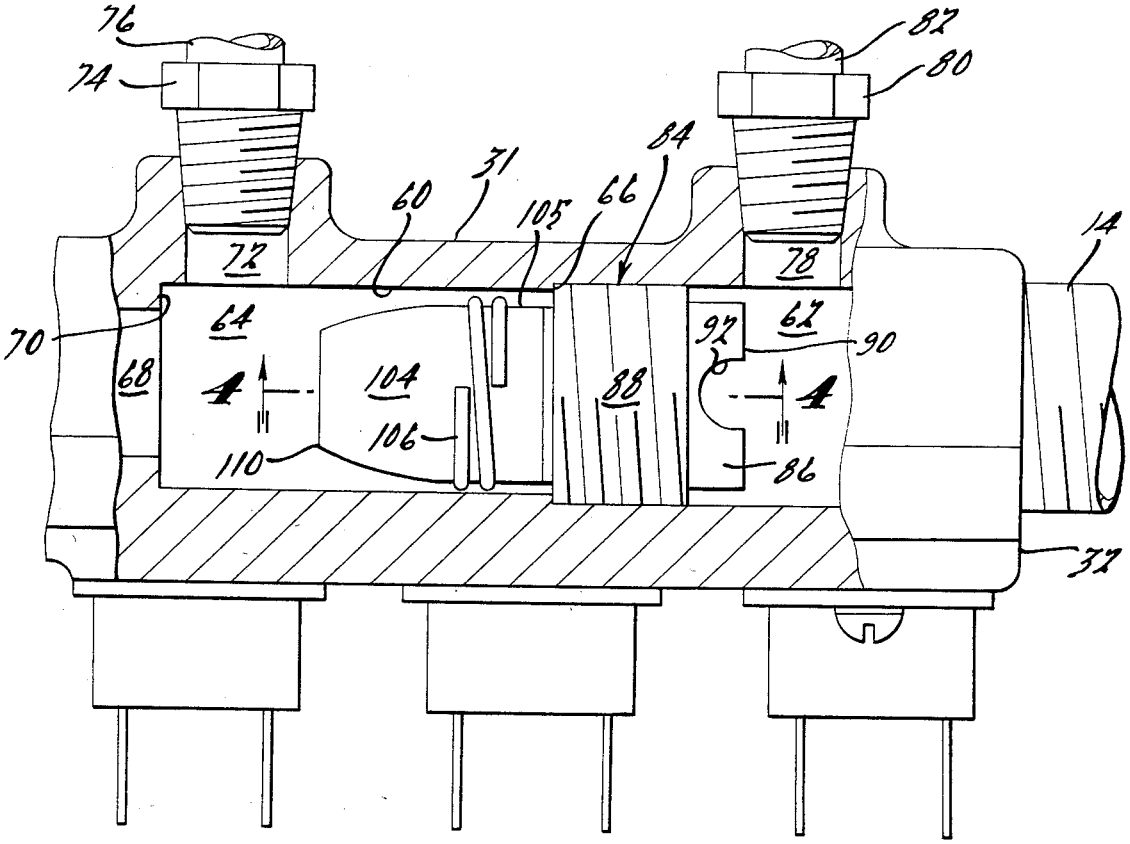
FIG. 3 is a partial sectional view of a portion of the present invention.

As shown in FIGS. 3, 4 and 6, the flow restrictor 84 also includes a generally cylindrical flexible flow restrictor sleeve 104 which is dimensioned to enable one of its ends 105 to be expanded and fitted over the collar portion 96 of diffuser 94. A retaining clip 106 cooperates with the circumferential ribs 98 on collar 96 to retain and locate the sleeve 104 in the manner shown in FIGS. 3 and 4 so that it cooperates with head 100 to define a circumferentially extending chamber 108. The sleeve 104 also defines a lip portion 110 having an inside diameter which is slightly greater than the diameter of shoulder 101 of head 100. As so dimensioned and retained, sleeve 104 cooperates with shoulder 101 to define an annular shaped aperture 112 communicating between chamber 108 and outlet chamber 64.

Figure 5:
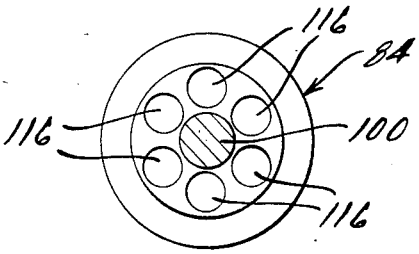
FIG. 5 is an end view of a portion of the present invention taken in the direction of Line 5—5 shown in FIG. 4.

As shown in FIGS. 4 and 5, the flow restrictor 84 is also formed with an axially extending internal bore 114 extending from end face 90 through shank 86 to and into the diffuser 94, and six circumferentially spaced transition holes 116, each of which communicates between bore 114 and chamber 108 at an angle relative to the axis of bore 114. As so designed, the flow restrictor 84 enables water to flow from inlet chamber 62 through bore 114 and transition holes 116 into chamber 108, and thereafter from chamber 108 through aperture 112 into outlet chamber 64 during operation of the system 10. Moreover, as described more fully below, the design of the flow restrictor 84 and its placement within passageway 60 creates a pressure differential between inlet chamber 62 and outlet chamber 64 as water flows from water inlet 32 to end fitting 28 which is effectively transmitted through pressure lines 76 and 82 as a pressure signal to the pressure differential switch 56 for activating and deactivating the heating elements 36.

Figure 7:
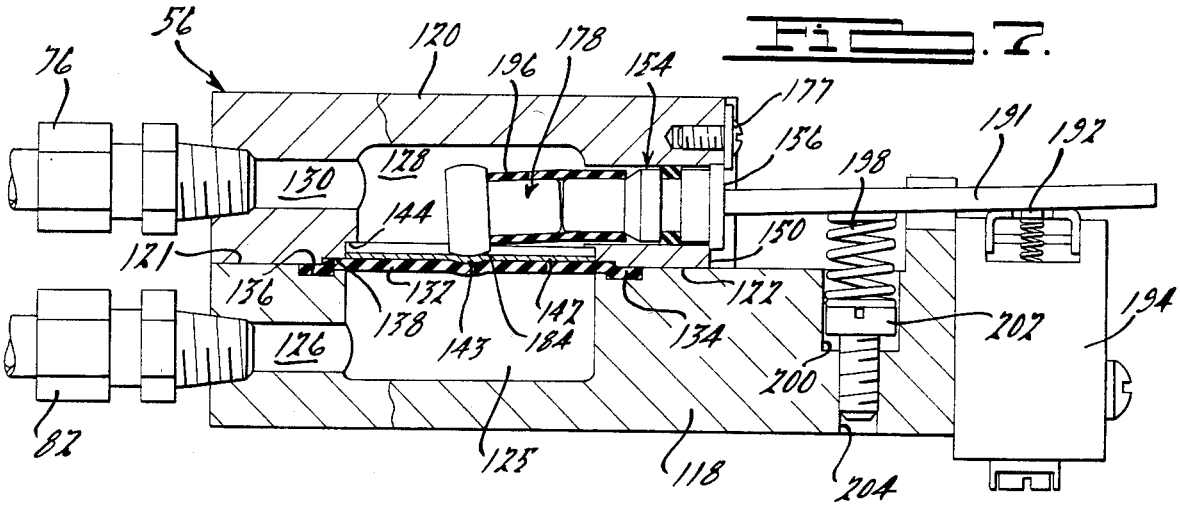
FIG. 7 is a sectional view of a portion of the invention taken generally in the direction of Line 7—7 of FIG. 1.
Figure 8:
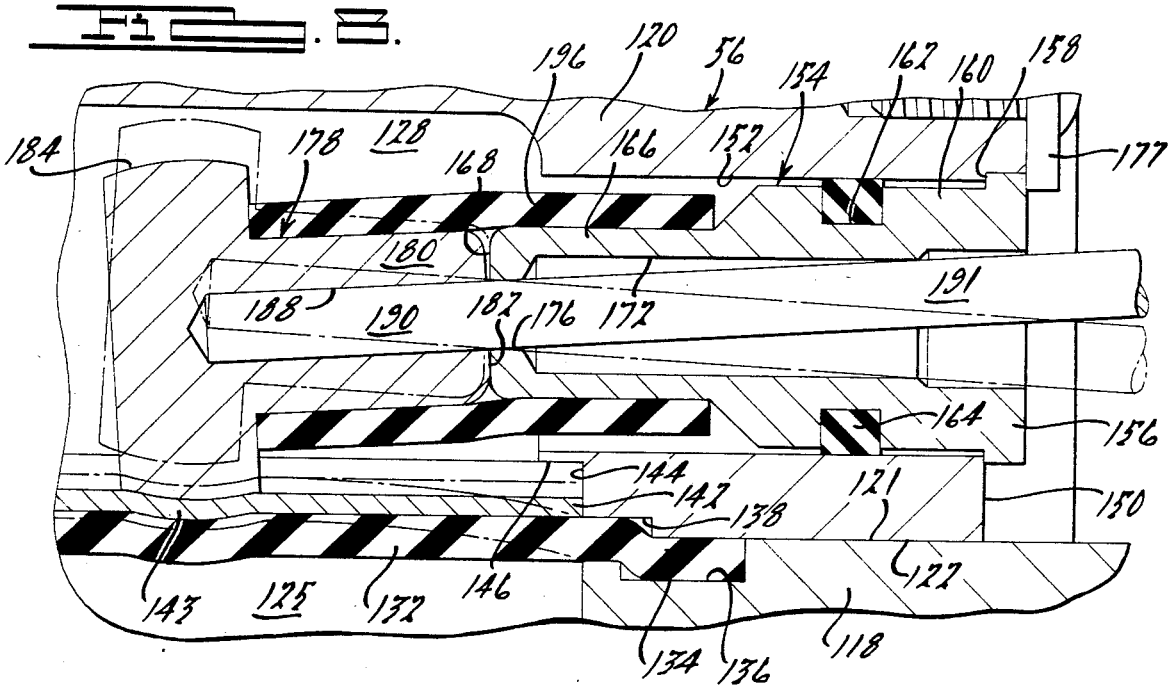
FIG. 8 is an enlarged sectional view, partially in phantom, of a portion of the invention shown in FIG. 7.

As shown in FIGS. 7 and 8, the pressure differential switch 56 includes switch housing portions 118 and 120 defining opposed faces 121 and 122 which are in abutting engagement upon assembly of the switch 56. Such assembly is effected by way of threaded fasteners 124 such as shown in FIG. 1. Formed within housing portion 118 is a high pressure chamber 125, and a high pressure channel 126 which communicates between chamber 125 and the outer surface of switch portion 118 for receiving and operatively connecting pressure line 82 with the switch 56. Housing portion 120 is similarly formed with a low pressure chamber 128 which opens to a low pressure channel 130 communicating with the exterior of housing portion 120 for receivably retaining and operatively connecting pressure line 76 with the switch 56.

Retained between housing portions 118 and 120 and separating chambers 125 and 128 is a flexible diaphragm 132. As shown in FIG. 7, the outer periphery 134 of diaphragm 132 is located and retained within and between an annular bore 136 in face 121 of housing portion 118 and a counterbore 138 formed in face 122 of housing portion 120. The configuration and dimensions of diaphragm 132, annular bore 136 and counterbore 138 allow the diaphragm 132 to flex in a direction extending between chambers 125 and 128 when a pressure differential exists between chambers 125 and 128. On the other hand, the periphery 134 of diaphragm 132 will operate as a seal to prevent water leakage from chambers 125 and 128 along faces 121 and 122 during operation of the system 10. Located within the low pressure chamber 128 adjacent diaphragm 132 is a rigid circular disk 142 having a depression or dimple 143 formed along its central axis. Disk 142 is situated to be engaged and moved by diaphragm 132 as it flexes in response to a pressure differential between chambers 125 and 128. The disk 142 is restrained from movement in a radial direction by, but is free to move in the direction of its central axis toward chamber 128, in a counterbore 144 having a diameter slightly greater than that of disk 142, but less than that of counterbore 138. As shown more fully in FIG. 8, the counterbore 144 is formed to define an annular shoulder 146 which defines the limit of axial movement of the disk 142 relative to and into chamber 128.

Switch housing portion 120 is also formed to define an end face 150 and a through aperture 152 which communicates between end face 150 and the pressure chamber 128. Carried within aperture 152 is an elongated pivot sleeve 154 having a head portion 156 which defines an annular shoulder 158 which engages end face 150 and an axially extending collar 160 as shown in FIG. 8. The collar 160 is formed with a circumferentially extending groove 162 for retaining an O-ring 164 to effect a seal within aperture 152 to prevent water leakage from chamber 128. Pivot sleeve 154 is also formed with a reduced diameter shank portion 166 extending axially from collar 160 and terminating in an end face 168. An axial counterbored hole 172 extends from head portion 156 along the length of pivot sleeve 154 and terminates within shank 166 as a reduced diameter aperture 176 opening through end face 168. The pivot sleeve 154 is press fitted within aperture 152 and retained therein by way of a retaining clamp or screw 177 as shown in FIGS. 7 and 8.

Carried within chamber 128 and extending through aperture 152 of housing portion 120 within pivot sleeve 154 is a tripper mechanism which responds to movement of disk 142 for activating the electrical system for energizing heating elements 36. The tripper mechanism includes a tripper head 178 formed to define a generally cylindrical shank portion 180 having roughly the same diameter as shank 166 of pivot sleeve 154 and which terminates in an end face 182. Tripper head 178 is also formed with a follower 184 operative to be received within dimple 143 in disk 142 to properly locate the tripper head 178 within chamber 128. A hollow bore 188 extends along the axis of shank 180 for receiving and retaining one end 190 of an elongated tripper pin 191. Pin 191 is dimensioned to allow it to pass through aperture 176 and extend the length of hole 172 in pivot sleeve 154. As shown in FIG. 7, the length of tripper pin 191 is moreover sufficient to enable it to exit housing portion 120 through head portion 156 of pivot sleeve 154 for engaging the switch lever 192 of an electrical switch 194 for activating and deactivating electrical system for delivering energy to heating elements 36.

The tripper mechanism also includes a flexible generally cylindrical sleeve 196 of a diameter which enables it to be fitted over shank 180 of tripper head 178 and shank 166 of pivot sleeve 154 and yet grip each of shanks 166 and 180 to effect a flexible assembly of tripper head 178 and tripper pin 191 with pivot sleeve 154, with shanks 166 and 180 in roughly coaxial alignment and end faces 168 and 182 in an opposed abutting relationship. This flexible assembly achieved by the flexible sleeve 196 enables the tripper head 178 and pin 191 to pivot relative to pivot sleeve 154, and pin 191 to move into and out of engagement with switch lever 192 in response to movement of diaphragm 132 and disk 142. The tripper mechanism is biased toward a normal "off" position with pin 191 disengaged from switch lever 192 by way of a spring 198 located within a recess 200 in housing portion 118 and which operatively engages tripper pin 191 as shown in FIG. 7. A set screw 202 threadably received within a threaded bore 204 in the bight portion of recess 200 engages the spring 198, and can be turned to adjust the biasing force placed upon the tripper pin 191 as desired.

As so designed, the heater actuating system 15 operates to activate and deactivate the heating elements 36 of the system 10 in the following manner. When a user desires hot water at a delivery location, such as a faucet connected to the hot water line 18, the user opens the faucet to initiate flow of water through the system 10. Water will then flow from the cold water inlet line 14 to and through water inlet 32 and into the inlet chamber 62 of passageway 60 in depending portion 31. It will thereafter flow through bore 114 of the flow restrictor 84, and through transition holes 116 into chamber 108. It will thereafter flow out of aperture 112 into outlet chamber 64 of passageway 60 and through aperture 68 and end fitting 28 into heating column 22 of the heat exchanger assembly 16. As shown in FIG. 1, the subsequent flow path of the water will be up through column 22 into end fitting 30 and down column 24 into and through end fitting 28. The water will thereafter flow into and up column 26 to end fitting 30 and pass through depending portion 33 and out through hot water outlet line 18 to the delivery location.

During the course of this flow through the system 10, water and/or water pressure is also bled from passageway 60 and delivered to high and low pressure chambers 125 and 128 of the pressure differential switch 56 through bore 72 and pressure line 76, and bore 78 and pressure line 82. Moreover, the design of flow restrictor 84, and particularly the geometry of transition holes 116, chamber 108 and aperture 112 restrict and change the direction of the flow path of water through passageway 60 sufficiently to create a back pressure or pressure differential across the flow restrictor 84 within passageway 60, with inlet chamber 62 defining a high pressure zone and outlet chamber 64 defining a low pressure zone. For this reason, a pressure differential will also exist in pressure lines 76 and 82, as well as between chambers 125 and 128 of the pressure differential switch 56 so as to create a hydraulic force against diaphragm 132 in the direction of low pressure chamber 128. This force will cause the diaphragm 132 to flex and bulge in the direction of chamber 128 and force disk 142 against follower 184 of tripper head 178 to effect pivotal movement of head 178 and tripper pin 191 such as shown in phantom in FIG. 8 for triggering the electrical switch 194 to initiate delivery of energy to heating elements 36. It has been found that a minimum of 0.7 to 1.0 gallons per minute of water flow are required in the heat exchanger assembly 16 during operation of the system 10 to avoid any undesired overheating of elements 36. Thus, the dimensions, geometry and material characteristics of the flow restrictor 84, and of the elements of the pressure differential switch 56, such as chambers 125 and 128, diaphragm 132, tripper head 178 and pin 191, sleeve 196, and spring 198, have been chosen to collectively cooperate to enable the pin 191 to overcome the biasing force of spring 198 and move into engagement with and trip switch lever 192 of the switch 194 for energizing heating elements 36 only when 0.7 to 1.0 gallons per minute of water are flowing through the system. Moreover, when such a threshold flow rate is lacking, the pivot force placed upon the pin 191 by diaphragm 132 and disk 142 will be insufficient to overcome spring 198, so that switch 194 will be deactivated to prevent overheating of the elements 36. It should also be noted that the flexible nature of the flow restrictor sleeve 104 causes the cross-sectional area of aperture 112 to increase as the rate of flow of water through the system 10 is increased. Thus, flow restrictor sleeve 104 will yield a non-linear pressure differential curve which will flatten out after operational flow rates have been reached in the system 10.

It has been found that the advantages of the above-described invention are best achieved by making the flexible flow restrictor sleeve 104, sleeve 196 for effecting assembly of tripper head 178 with pivot sleeve 154, and diaphragm 132 from a silicone material, and by making disk 142 from stainless steel. Due to material variations and manufacturing tolerances, it is possible for the characteristics each of the elements of flow restrictor 84 and pressure differential switch 56 to vary from unit to unit. However, such variations can be accommodated from unit to unit by adjustment of set screw 202 to adjust the spring biasing force placed upon pin 191 in any particular unit so that the heating elements 36 will be activated only when the flow rate within a particular system is above the desired threshold flow rate of 0.7 to 1.0 gallons per minute.

Figure 9:
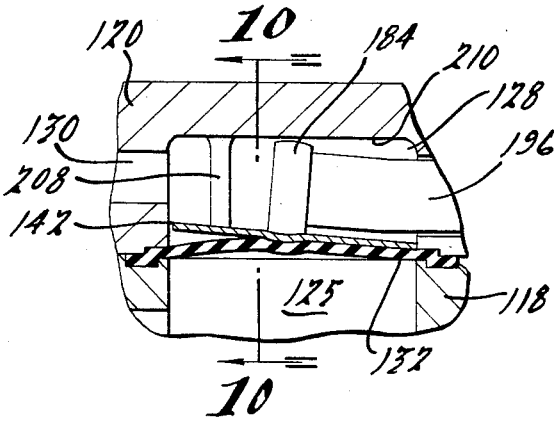
FIG. 9 is a sectional view showing an alternate embodiment of the invention.
Figure 10:
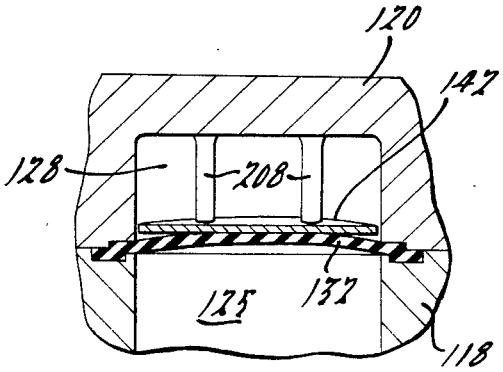
FIG. 10 is a sectional view taken generally in the direction of Line 10—10 of FIG. 9.

The preferred embodiment of the invention is also provided with the previously described counterbore 144 in switch housing portion 120 to limit movement of disk 142 into the low pressure chamber 128. The provision of counterbore 144 is necessary to avoid undesired cocking and possible jamming of the disk 142 within chamber 128 during operation of the system 10. An alternative means for achieving such a limit upon overall movement of disk 142 and to control its orientation during system operation is illustrated in FIGS. 9 and 10. In this embodiment of the invention, housing portion 120 is formed with a pair of depending projections 208 extending substantially normally of the interior wall 210 of chamber 128 which operate to engage and limit movement of disk 142 in the manner shown in the above noted Figures. Other methods for limiting movement of disk 142 could include the provision of similar projections from the side walls of the chamber 128 or a provision of threaded fasteners having heads extending into chamber 128.

It is understood that the foregoing description is that of the the preferred embodiments of the invention and that various changes and modifications may be made thereto without departing from the spirit and scope of the invention as defined in the appended claims.

What is claimed is:

1. In a rapid response water heating and delivery system having a water inlet location, a water outlet location, a flow path along which water flows through the system between the water inlet location and the water outlet location, a heat exchanger assembly for delivering thermal energy to the water as it moves along the flow path, and an energizing system which powers the heat exchanger assembly, the improvement comprising means for generating a pressure differential between a first location along said flow path and a second location along said flow path and which varies in accordance with the rate of flow of water along said flow path, and a pressure differential sensor which senses said pressure differential and generates an output signal for activating said energizing system when the flow rate along said flow path reaches a predetermined threshold level, said pressure differential sensor including first and second pressure lines communicating with said first and second locations along said flow path and which are operative to transmit water from said first and second locations at pressures corresponding with those existing at said first and second locations, a housing formed with a high pressure chamber operatively connected with said first pressure line for receiving and holding water at a pressure corresponding to that existing at said first location and a low pressure chamber communicating with said high pressure chamber and operatively connected with said second pressure line for receiving and holding water at a pressure corresponding to that existing at said second location, a flexible diaphragm extending between said high and low pressure chambers which prevents water flow between said high and low pressure chambers and which is operative to move in the direction of said low pressure chamber when a pressure differential exists between said high and low pressure chambers, and a trigger means extending through said housing and which is operative to be moved by said diaphragm to generate said output signal by engaging an activating switch of said energizing system, said trigger means including a hollow sleeve carried within an aperture communicating between said low pressure chamber and the exterior of said housing, a follower having a follower surface within said low pressure chamber and an elongated pin extending through said aperture within said sleeve for engaging said activating switch, and a rigid disk disposed within said low pressure chamber between said diaphragm and said follower surface and operative to be moved by said diaphragm into engagement with said follower surface to effect movement of said follower surface within said low pressure chamber and movement of said pin into engagement with said activating switch.

2. A rapid response water heating and delivery system as set forth in claim 1 wherein said flexible diaphragm operates to seal said high pressure chamber and said low pressure chamber.

3. A rapid response water heating and delivery system as set forth in claim 1 wherein said rigid disk is made of stainless steel.

4. A rapid response water heating and delivery system as set forth in claim 1 wherein said sleeve retains and locates an O-ring for sealing said aperture to prevent leakage of water from said low pressure chamber through said aperture.

5. A rapid response water heating and delivery system as set forth in claim 1 wherein said follower is supported for pivotal movement relative to said housing by said sleeve.

6. A rapid response water heating and delivery system as set forth in claim 1 wherein said trigger means further includes a seal for preventing leakage of water from said low pressure chamber through said hollow sleeve.

7. A rapid response water heating and delivery system as set forth in claim 1 wherein said follower is assembled to said hollow sleeve by a flexible joint within said low pressure chamber which supports said follower for pivotal movement relative to said hollow sleeve and which effects a seal between said low pressure chamber and the interior of said hollow sleeve.

8. A rapid response water heating and delivery system as set forth in claim 7 wherein said flexible joint is comprised of a silicone material.

9. A rapid response water heating and delivery system as set forth in claim 1 wherein said trigger means includes means for limiting movement of said rigid disk into said low pressure chamber.

10. A rapid response water heating and delivery system as set forth in claim 1 wherein said rigid disk is retained for movement in a counterbore formed in the peripheral walls of said low pressure chamber and having an engagement surface that limits movement of said rigid disk into said low pressure chamber.

11. A rapid response water heating and delivery system as set forth in claim 1 wherein an interior surface of said low pressure chamber is formed with at least one rigid projection extending into said low pressure chamber and which is operative to engage said rigid disk to limit movement of said rigid disk into said low pressure chamber.

12. A rapid response water heating and delivery system as set forth in claim 1 wherein said trigger means further includes means for biasing said pin toward a normally off position where it is disengaged from said activating switch.

13. A rapid response water heating and delivery system as set forth in claim 12 wherein said biasing means includes means for adjusting the level of biasing force applied to said pin.

14. A rapid response water heating and delivery system as set forth in claim 12 wherein said biasing means is located on the exterior of said housing.

15. A rapid response water heating and delivery system as set forth in claim 1 wherein said diaphragm is comprised of a silicone material.

16. A rapid response water heating and delivery system as set forth in claim 1 wherein the pressure differential created by said pressure differential generating means varies in a non-linear fashion relative to changes in the rate of flow of water along said flow path.

17. A rapid response water heating and delivery system as set forth in claim 1 wherein said pressure differential generating means comprises an elongated rigid fitting formed with a through passageway communicating with said first location through which water may flow from said first location, and a flexible membrane which cooperates with a portion of said rigid fitting to define a flow restricting chamber at one end of said through passageway and which has an exit opening through which water may flow from said flow restricting chamber to said second location.

18. A rapid response water heating and delivery system as set forth in claim 17 wherein the size of said exit opening changes with the rate of flow of water along said flow path.

19. A rapid response water heating and delivery system as set forth in claim 17 wherein said fitting includes an elongated diffuser head defining a generally cylindrical outer surface, and said membrane comprises a hollow flexible sleeve disposed radially outwardly from said cylindrical outer surface and which cooperates with said surface to define a generally annular exit opening from said flow restricting chamber.

20. A rapid response water heating and delivery system as set forth in claim 17 wherein said flexible membrane is comprised of a silicone material.

21. A rapid response water heating and delivery system as set forth in claim 17 wherein said rigid fitting is operative to be threadably retained within said flow path.

* * * * *